US009630425B2

(12) United States Patent
Zavada et al.

(10) Patent No.: US 9,630,425 B2
(45) Date of Patent: Apr. 25, 2017

(54) METHOD AND APPARATUS FOR CREATING 3D EFFECTS WITH CERAMIC INKJET INKS

(71) Applicant: Electronics for Imaging, Inc., Fremont, CA (US)

(72) Inventors: Mark Zavada, Wixom, MI (US); David Weber, Middleton, WI (US); Ursula Good, Jackson, MI (US)

(73) Assignee: ELECTRONICS FOR IMAGING, INC., Fremont, CA (US)

( * ) Notice: Subject to any disclaimer, the term of this patent is extended or adjusted under 35 U.S.C. 154(b) by 0 days.

(21) Appl. No.: 14/695,856

(22) Filed: Apr. 24, 2015

(65) Prior Publication Data

US 2016/0311231 A1 Oct. 27, 2016

(51) Int. Cl.
*B41J 3/407* (2006.01)
*B41J 3/38* (2006.01)

(52) U.S. Cl.
CPC *B41J 3/407* (2013.01); *B41J 3/38* (2013.01)

(58) Field of Classification Search
CPC ..... B41J 3/407; B41J 3/38
See application file for complete search history.

(56) References Cited

U.S. PATENT DOCUMENTS 6,402,823 B1 * 6/2002 Garcia Sainz ..... C09D 11/40 106/31.62
2010/0291362 A1 * 11/2010 Vignali ..... B41M 5/007 428/210
2013/0265376 A1 10/2013 Gil-Torrente et al.
2014/0196618 A1 * 7/2014 Pervan ..... B41J 3/28 101/32

* cited by examiner

*Primary Examiner* — Bradley Thies
(74) *Attorney, Agent, or Firm* — Perkins Coie LLP; Michael A. Glenn

(57) ABSTRACT

A 3D relief effect is created on a ceramic tile with an inkjet printer and an inkjet print head by printing a relief pattern with an effect ink having a low surface tension on the ceramic tile. The inkjet printer and inkjet print head apply an aqueous glaze slurry having a high surface tension on top of the effect ink. An image is printed on the glaze and the tile is fired. A difference in surface tensions causes the aqueous glaze to move away from the printed effect ink, resulting in a relief pattern in the image at locations of the printed relief pattern.

11 Claims, 3 Drawing Sheets

METHOD AND APPARATUS FOR CREATING 3D EFFECTS WITH CERAMIC INKJET INKS

FIELD

The invention relates to inkjet printing. More particularly, the invention relates to a method and apparatus for creating 3D effects with ceramic inkjet inks.

BACKGROUND

Ceramic inkjet 3D effects are currently being achieved by use of either an additive process that involves jetting ceramic material on to a tile or a subtractive-like process that involves jetting a ceramic fluxing material on to a glazed tile. This results in a relief that is uniform and generally well matched to the under-glaze that it is jetted on. Both methods can create patterns and enhance printed images, for example wood grain.

Texture and 3D glaze effects are known within the traditional ceramic community. These textured glazes are manually applied to produce an artistic effect known as blister, bubble, and wax resist effects. The technique known as wax resist produces textural and relief effects by applying a wax-like material to the ceramic piece prior to glazing. Due to surface tension, an aqueous glaze avoids any region where the wax-like material is applied, thus producing the effect. Currently, the designs produced by this technique are applied by a manual or analogue process.

SUMMARY

Embodiments of the invention combine inkjet and wax resist techniques to produce a 3D relief effect using an inkjet ink. The incorporation of inkjet technology allows for precise control over the location and degree of relief.

DRAWINGS

Figure 1:
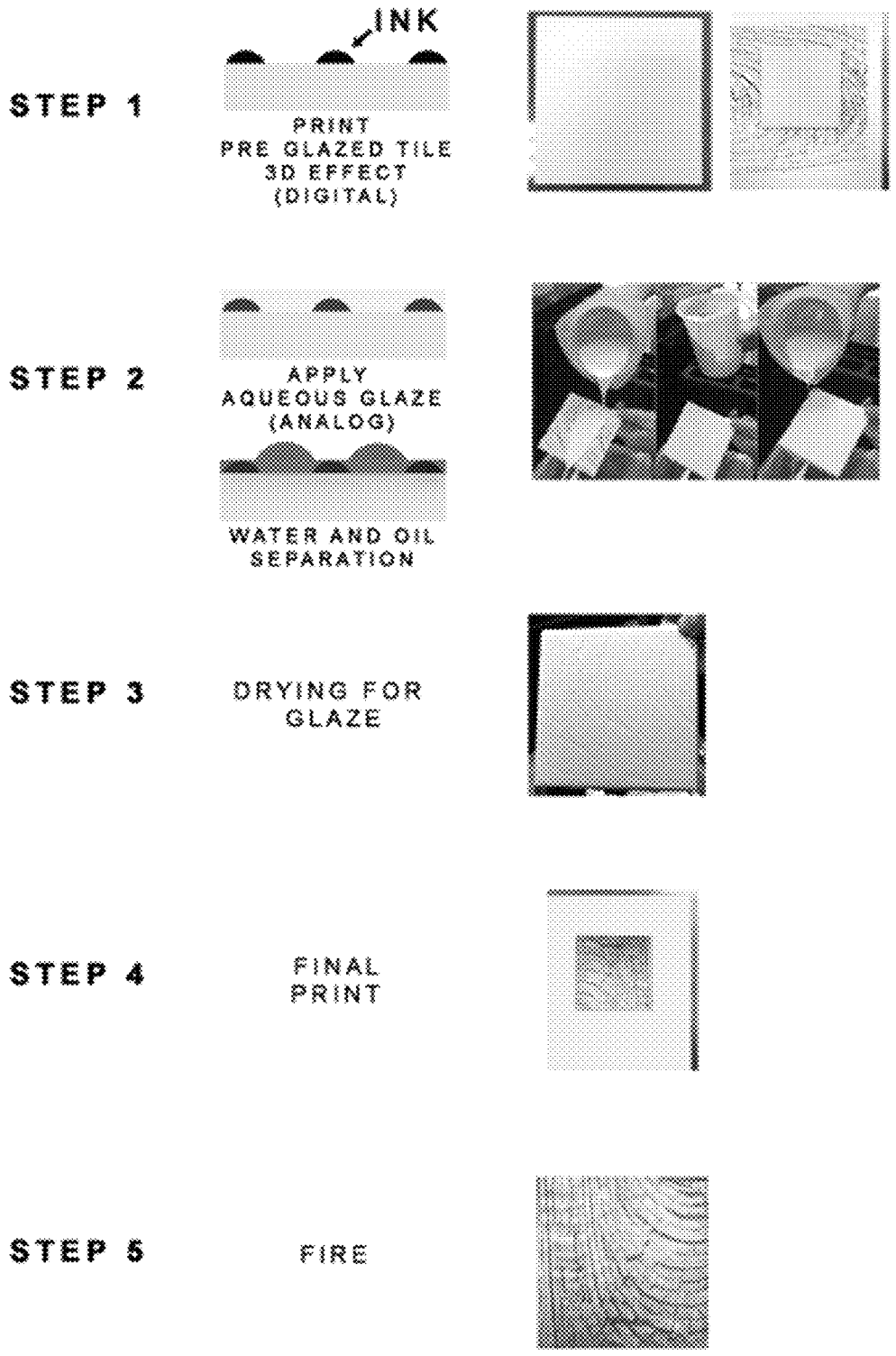
Figure 2:
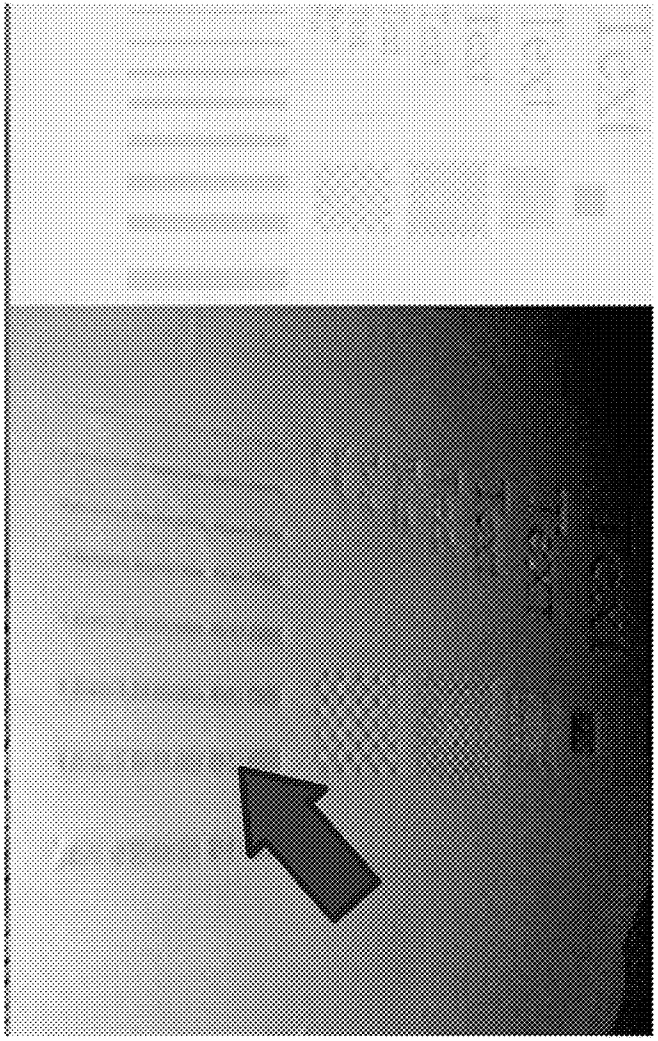
Figure 3:
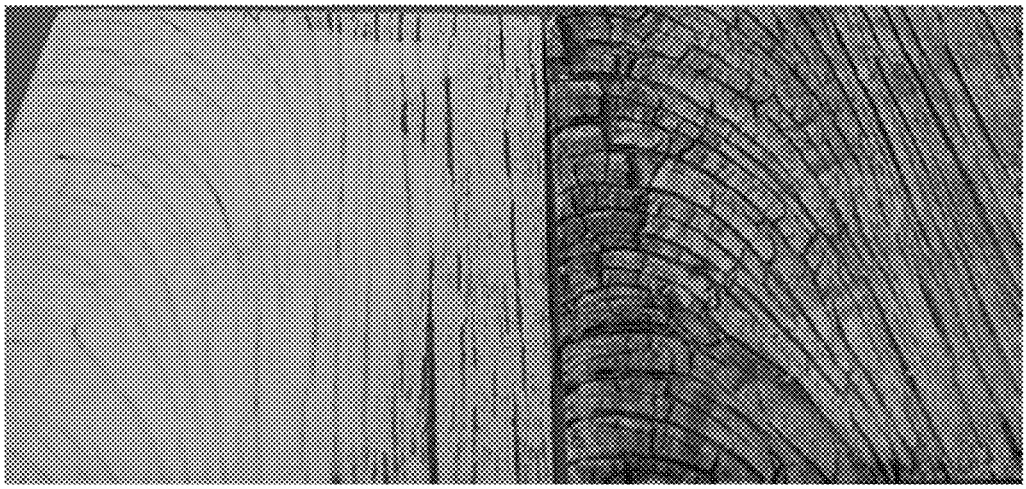

FIG. 1 is a flow diagram showing the steps executed to print a relief effect on a ceramic tile according to the invention; and FIGS. 2 and 3 provide proof of concept examples of the relief effect achieved with embodiments of the invention when applied to fired tiles with semi-matte glaze.

DESCRIPTION

Embodiments of the invention combine inkjet and wax resist techniques to produce a 3D relief effect using an inkjet ink. The incorporation of inkjet technology allows for precise control over the location and degree of relief.

Embodiments of the invention provide a method and apparatus for using an ink jet ink to form a specific artistic effect on, for example ceramic tiles. Such effects can include, for example, wood grain, cobblestone, picture frames, text, custom designs, and custom artwork.

This effect is often referred to as a wax resist. In embodiments of the invention, this effect is produced when an aqueous glaze slurry, having a high surface tension, is layered on top of a printed effect ink, having a low surface tension. The difference in surface tensions causes the glaze material to move away from the printed ink. This results in a relief pattern at the location of the printed image.

The area and depth of the relief is dependent on the area and quantity of printed ink. This 3D effect on tile was demonstrated with the application of a single 84 picoliter drop of the effect ink with the aqueous glaze applied by the waterfall method, although smaller drops may also result in the effect. The largest area successfully voided of glaze material with the 3D effect ink was 1 sq. in., but larger areas may demonstrate the effect.

In embodiments of the invention, the effect ink may or may not be a curable fluid and may or may not contain solid components. Non-curable effect inks may include inks containing the following fluids and solvents: aliphatic and aromatic hydrocarbons, natural and synthetic oils, fatty acid esters, ketones, ethers, alcohols, amides, amines, esters, silicone oils, silanes, siloxanes, water, and others. Non-curable effect inks may include inks containing the following polymers and oligomers in solution or dispersion: polyolefins, polyurethanes, polyesters, polyamides, polyamines, polyketones, polystyrene, polycarbonates, polybutadiene and other rubbers, fluorinated polymers (such as polytetrafluoroethylene), and others. Non-curable effect inks may include inks containing the following solid components: clays, feldspars, silicas, frits, alumina, metals, metal-oxides, metal-nitrides, organic dyes and pigments, inorganic dyes and pigments. Curable effects inks may include inks containing the previous and following materials: acrylates, epoxies, melamines, isocyanates, unsaturated triglycerides, and other hydrophobic fluids, polymers, resins, and solids. The curing may or may not be promoted by radiation (such as UV or microwave), heat, solvent evaporation, chemical equilibrium, air exposure, and/or water exposure.

The effect ink can be printed on dry tile; engobe, i.e. a clay slip coating applied to a ceramic body; or glaze. For ceramics, this method is compatible with glossy to matte glazes. Glaze and engobes are composed of various clays, feldspars, frits and elemental oxides. Exact elemental compositions and blend ratios are region dependent due to the variability in composition of locally sourced earth.

Depending on the desired final appearance or performance, the ratios of the previously mentioned materials is distributed; for example, the main difference between a glossy and matte glaze is the amount of silica used in the formula.

The effect ink must be printed before at least one application of an aqueous mixture, e.g. engobe and glaze slurries, as described above.

In embodiments of the invention, one or more aqueous mixtures may be applied by analog or digital methods that are well known within the art, e.g. spray and waterfall.

Further, embodiments of the invention may be used for applications other than ceramics by changing the substrate and top mixture.

FIG. 1 is a flow diagram showing the steps executed to print a relief effect on a ceramic tile according to the invention.

At Step 1, a pre-glazed tile is printed with a digital ink to provide a 3D effect. The 3D effect ink is printed as an image generated by a designer. The effect ink can be clear and colorless. A dye or pigment may be included for visual inspection purposes, but is not necessary to produce the effect. The amount of ink applied to the substrate is determine by the following variables: the digital image used by the printer, the print head make and model, print head parameters (piezo voltage, waveform, jet temperature, etc.) and number of print passes. Ink properties, such as viscosity, density, electrical conductivity, and maximum particle diameter, if applicable, are limited only by the capabilities of the printer and print head used to print the image. The image printed with the 3D effect ink can be generated in any software capable of producing image files, such as Adobe Photoshop.

At Step 2, an aqueous glaze is applied to the tile. As can be seen, the nature of the ink and aqueous glaze is such as to cause a separation.

At Step 3, the glaze is dried according to industry standards that are well known within the art. The glaze should be dry enough to absorb the printed ink without distorting the image. This could be accomplished by naturally air drying or accelerated through the use of drying ovens, fans, and/or vacuum systems for a predetermined amount of time.

At Step 4, the final image is printed. In FIG. 1, the image is that of a wood grain.

At Step 5, the printed tile is fired according to industry standards that are well known within the art. Typical temperatures may range from 1060° C. to 1250° C. and firing durations vary from 35 minutes to 120 minutes per firing cycle.

FIGS. 2 and 3 provide proof of concept examples of the relief effect achieved with embodiments of the invention when applied to fired tiles having a semi-matte glaze.

In FIG. 2, the portion of the image at the left shows a pattern used to print the effect ink; and in FIG. 2, the portion of the image at the right shows the effect ink printed on a bisque-fired ceramic tile in a single print pass. A black dye was incorporated into the ink as a visual aid but not necessary for the effect; otherwise, the 3D effect image would not be visible prior to the next step.

For the tile of FIG. 2, aqueous glaze was poured on to the tile after printing and the tile was fired in a Nannetti roller kiln to 1145° C. in a one-hour start-to-finish firing cycle. Notice in FIG. 2 that the resolution of the effect was strong enough for defects from the poor quality print head to appear in the relief pattern. The defect appears as thin lines in the print direction, and is caused by clogged or damaged print head nozzles.

In FIG. 3, the portion of the image at the left shows the effect ink, with black dye included in the ink as a visual aid, printed on a bisque-fired ceramic tile. Aqueous glaze was applied by waterfall method to the tile after printing. The tile was fired in a Nannetti roller kiln to 1145° C. in a one hour start-to-finish firing cycle; and in FIG. 3, the portion of the picture at the right shows same image printed with the 3D effect ink and glaze applied by waterfall method. The glaze was dried for 30 minutes in a 60° C. laboratory oven before the full color image was printed on top. After the full color image was printed, the tile was fired in a Nannetti roller kiln to 1145° C. in a one hour start-to-finish firing cycle.

Although the invention is described herein with reference to the preferred embodiment, one skilled in the art will readily appreciate that other applications may be substituted for those set forth herein without departing from the spirit and scope of the present invention. Accordingly, the invention should only be limited by the Claims included below.

The invention claimed is:

1. A method for creating a 3D relief effect on a ceramic tile, comprising in order the following steps:

step one, with an inkjet printer and an inkjet print head, printing a relief pattern with an effect ink having a low surface tension on a ceramic tile;

step two, with said inkjet printer and an inkjet print head, applying an aqueous glaze slurry, having a high surface tension, on top of said effect ink;

step three, printing an image on said glaze; and step four, firing said tile;

wherein a difference in surface tensions causes the aqueous glaze to move away from the printed effect ink, resulting in a relief pattern in said image at locations of the printed relief pattern.

2. The method of claim 1, wherein area and depth of the relief pattern is determined by the area and quantity of printed effect ink.

3. The method of claim 1, wherein the effect ink comprises a curable fluid.

4. The method of claim 1, further comprising:

printing the effect ink on any of a dry tile; an engobe; and a glaze.

5. The method of claim 4, wherein said glaze comprises any of glossy and matte glazes.

6. The method of claim 4, further comprising:

printing the effect ink before at least one application of an aqueous mixture.

7. The method of claim 1, further comprising:

applying one or more aqueous mixtures by any of analog methods, digital methods, or by a combination of both analog and digital methods.

8. The method of claim 1, further comprising:

drying said aqueous glaze before printing said image.

9. A method for creating a 3D relief effect on a substrate, comprising in order the following steps:

step one, with an inkjet printer, using an inkjet print head, printing an ink on said substrate to provide a 3D effect;

step two, with said inkjet printer, and an inkjet print head, applying an aqueous glaze over said ink on said substrate;

step three, drying the glaze; and step four, with the inkjet printer, and an inkjet print head, printing an image over said glaze.

10. The method of claim 9, wherein said substrate comprises a pre-glazed ceramic tile and further comprises firing the tile after said image is printer thereon.

11. The method of claim 9, wherein said image comprises a wood grain.

* * * * *